US007489217B2

(12) United States Patent
Rohrig, III et al.

(10) Patent No.: US 7,489,217 B2
(45) Date of Patent: Feb. 10, 2009

(54) MAGNETIC PROXIMITY SENSOR

(76) Inventors: Vincent W. Rohrig, III, 86 Winston Dr., Hamilton, OH (US) 45013; Mark E. Peters, 7105 Vailsgate Ct., Liberty Township, OH (US) 45011

( * ) Notice: Subject to any disclaimer, the term of this patent is extended or adjusted under 35 U.S.C. 154(b) by 104 days.

(21) Appl. No.: 11/739,350

(22) Filed: Apr. 24, 2007

(65) Prior Publication Data

US 2008/0266035 A1 Oct. 30, 2008

(51) Int. Cl.
*H01H 9/00* (2006.01)

(52) U.S. Cl. ..... 335/205; 324/207.26; 335/207

(58) Field of Classification Search ..... 335/205–207; 324/207.11, 207.13, 207.24, 207.26
See application file for complete search history.

(56) References Cited

U.S. PATENT DOCUMENTS 4,117,431 A 9/1978 Eicher
4,837,539 A * 6/1989 Baker ..... 335/207

* cited by examiner

*Primary Examiner*—Ramon M Barrera
(74) *Attorney, Agent, or Firm*—Theresa Fritz Camoriano; Camoriano and Associates; Guillermo Camoriano

(57) ABSTRACT

A magnetic proximity sensor includes first and second contacts and a common contact and an actuator shaft, wherein the position of the common contact is determined by the position of the shaft, but the force between the contacts is independent of the position of the shaft.

12 Claims, 6 Drawing Sheets

MAGNETIC PROXIMITY SENSOR

BACKGROUND

The present invention relates to a proximity sensor.

Among the prior art is a sensor manufactured by a company called TopWorx, Inc. of Louisville, Ky. called a "GO" switch. This switch is advertised as having only one moving part, which is the push-pull plunger (hereinafter also referred to as the shaft). The electrical contact is attached directly to the shaft and moves linearly with the motion of the shaft. As with any mechanical contact, there is an inherent contact bounce that is approximately 2 milliseconds. The biggest disadvantage of this contact bounce is a "teasing" effect which causes premature contact failure. A weak magnetic field acting on the shaft can close the electrical contact but not provide sufficient contact pressure. The resulting "teasing", or contact chattering, can result in excessive heat which is detrimental to the contact's service life.

DESCRIPTION

Figure 1:
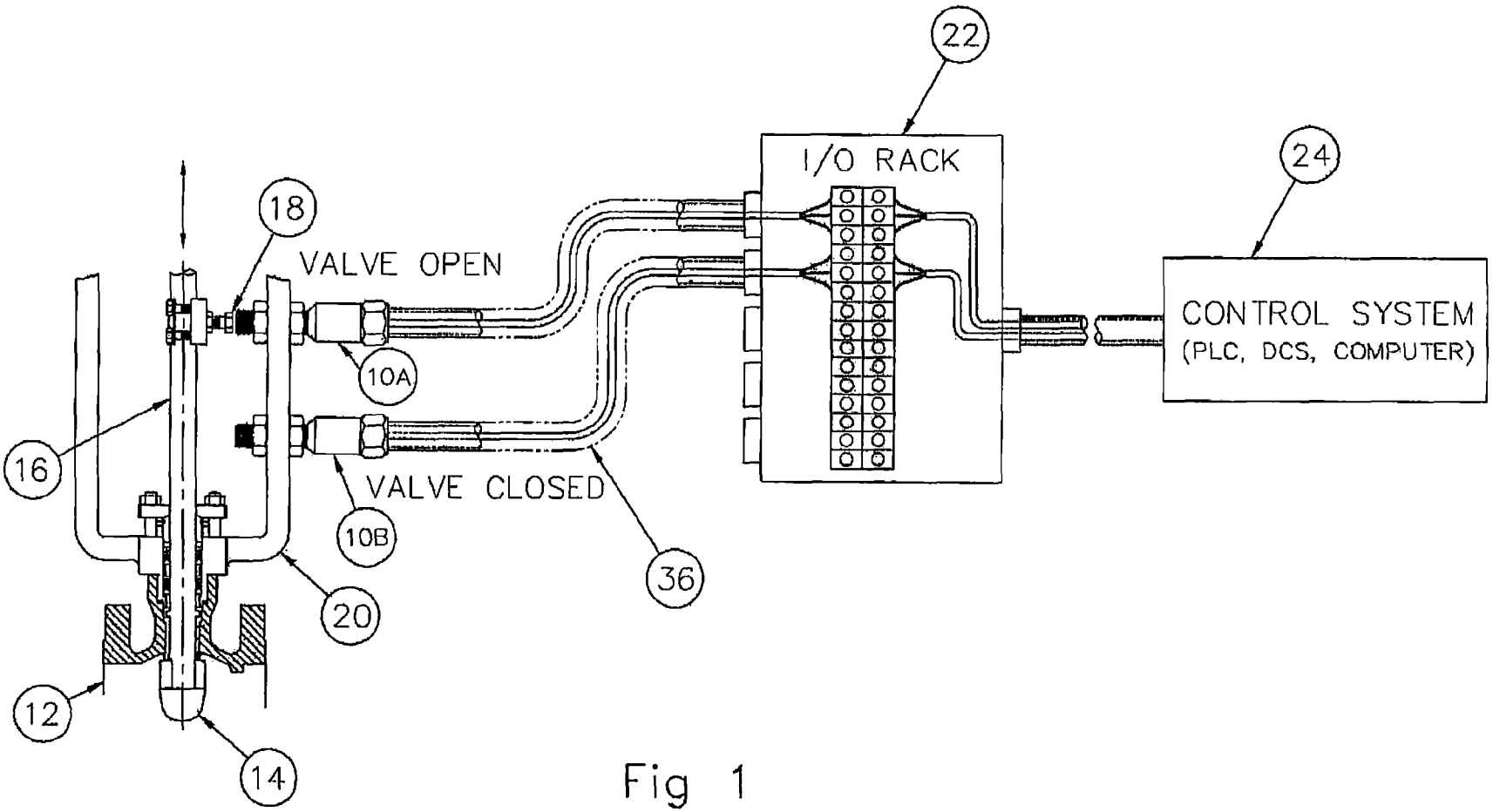
FIG. 1 is a schematic view, partially in cross section and partially broken away, of a typical application installation for a magnetic proximity sensor made in accordance with the present invention.

FIG. 1 shows a typical application installation for two magnetic proximity sensors 10A, 10B made in accordance with the present invention. In this view, a valve 12 has a plug 14 connected to a stem 16 which extends vertically upwardly. As the stem 16 travels downwardly, it pushes the plug 14 into the valve seat (not shown) of the valve 12 to close the valve 12. As the stem 16 travels upwardly, it pulls the plug 14 away from the seat of the valve 12 to open the valve 12. A ferrous target 18 is secured to the stem 16 such that the target 18 also travels vertically along with the stroke of the valve 12.

Two identical magnetic proximity sensors 10A, 10B are mounted on a bracket 20 secured to the valve body such that the target 18 is horizontally aligned with the upper proximity sensor 10A when the valve 12 is in the valve-open position, and the target 18 is horizontally aligned with lower proximity sensor 10B when the valve 12 is in the valve-closed position.

As depicted in FIG. 1, the proximity sensors 10A, 10B are wired to an input/output rack 22, which in turn is connected to a control system 24 such as a PLC or a computer.

Figure 2:
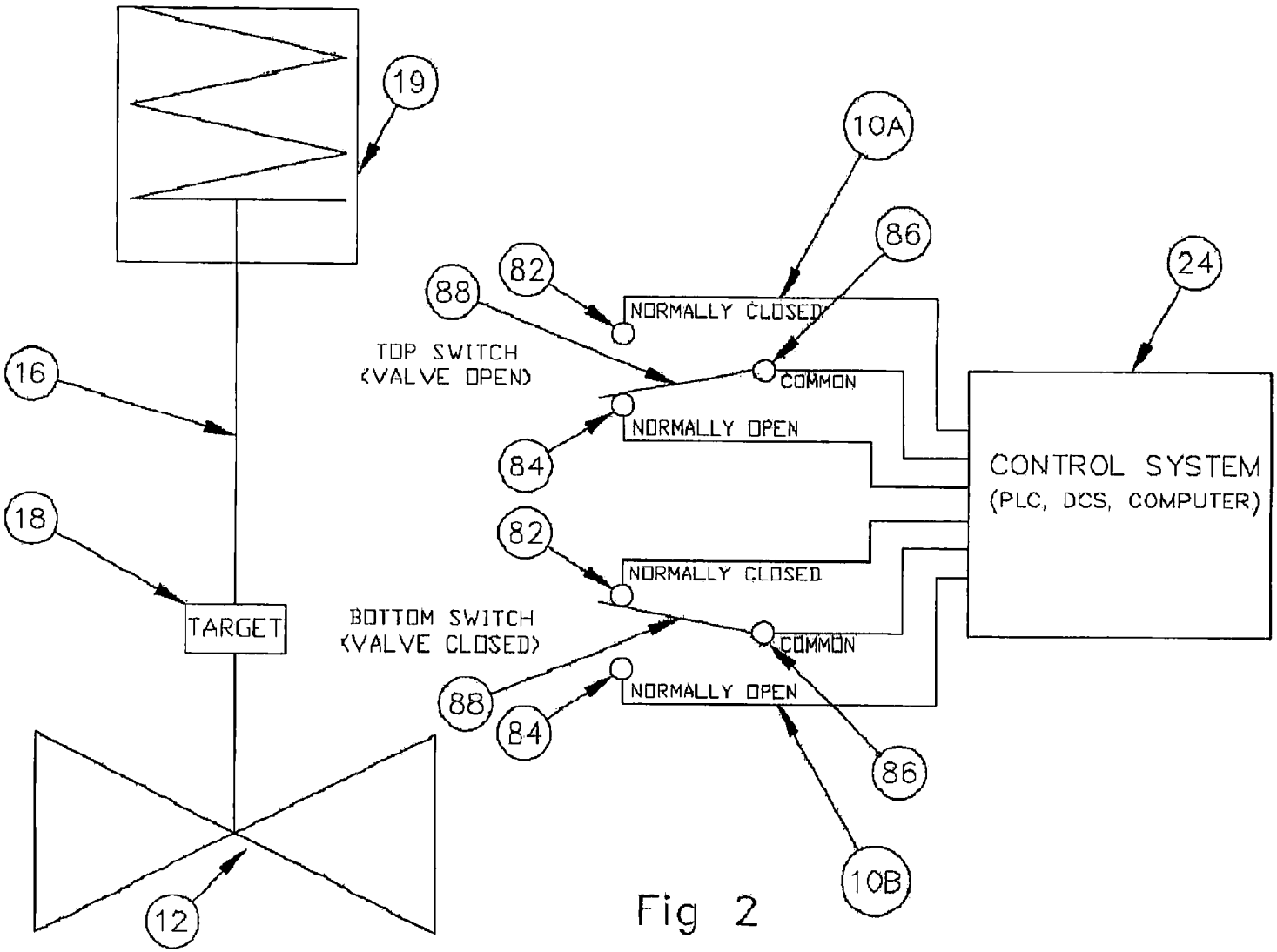
FIG. 2 is an electrical schematic of the application depicted in FIG. 1.

FIG. 2 is an electrical schematic diagram of the installation of FIG. 1. In this view, the target 18 is horizontally aligned with the lower proximity sensor 10B, such that (as explained in more detail below) the switch of this proximity sensor 10B is in its first position, connecting its first contact 82 with its common contact 86, and sending a signal to the control system 24 that the valve 12 is in the valve-closed position. At the same time, the upper proximity sensor 10A (which does not have the target 18 horizontally aligned with it) has its switch in the second position, connecting its second contact 84 to its common contact 86, indicating to the control system 24 that the valve 12 is not in the valve-open position.

The control system 24 or an operator may send a signal to the valve actuator 19 to open the valve 12. As the actuator 19 pulls the stem 16 upwardly, the target 18 moves away from the lower proximity sensor 10B. This causes the lower sensor 10B to switch to its second position, connecting its common contact 86 to its second contact 84, which sends a signal to the control system 24 indicating that the valve is not in the valve-closed position. When the target 18 reaches horizontal alignment with the upper sensor 10A, the upper sensor 10A moves to its first position, connecting its common contact 86 to its first contact 82, sending a signal to the control system 24 that the valve 12 is in the valve-open position.

Figure 3:
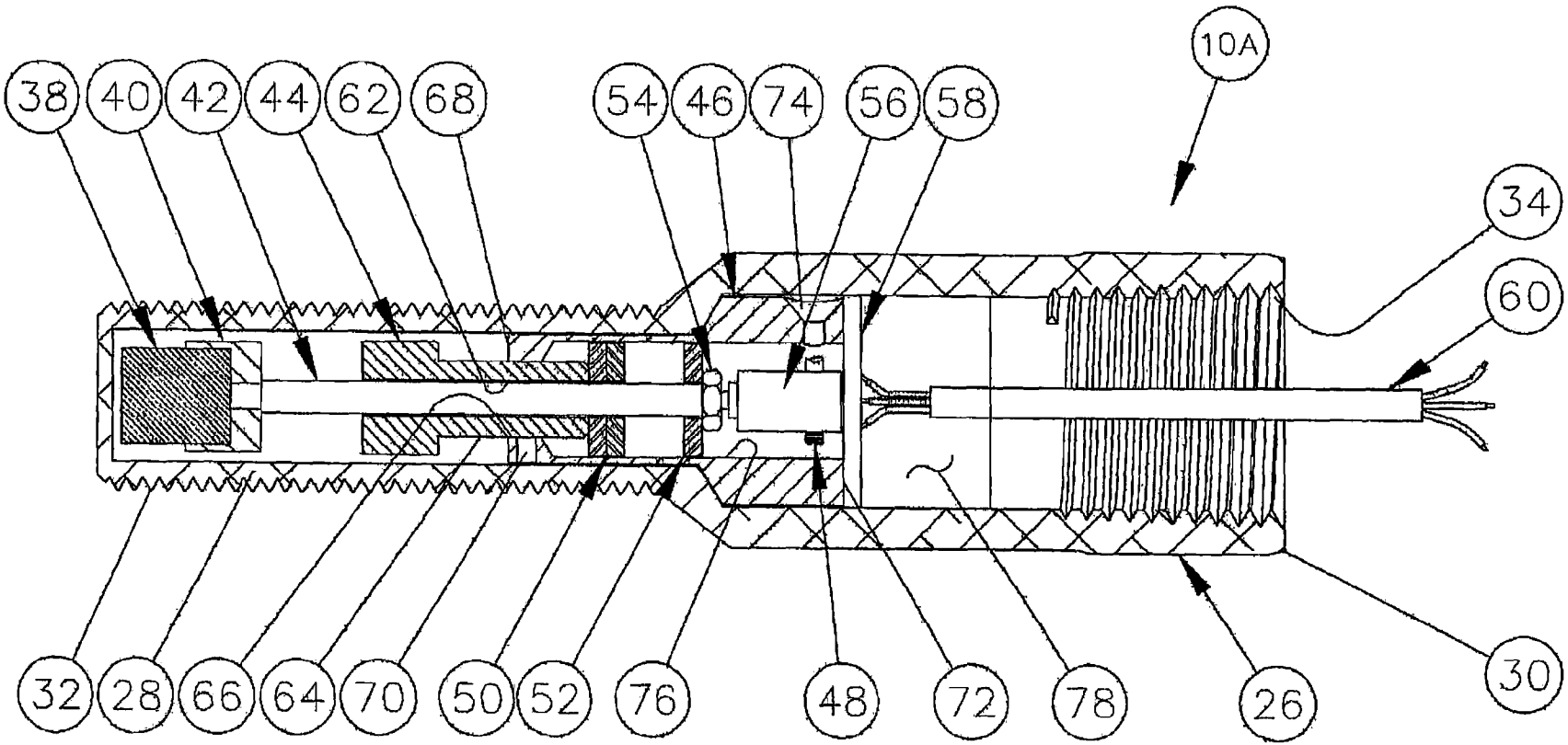
FIG. 3 is a cross sectional view of the proximity sensor of FIG. 1.
Figure 4:
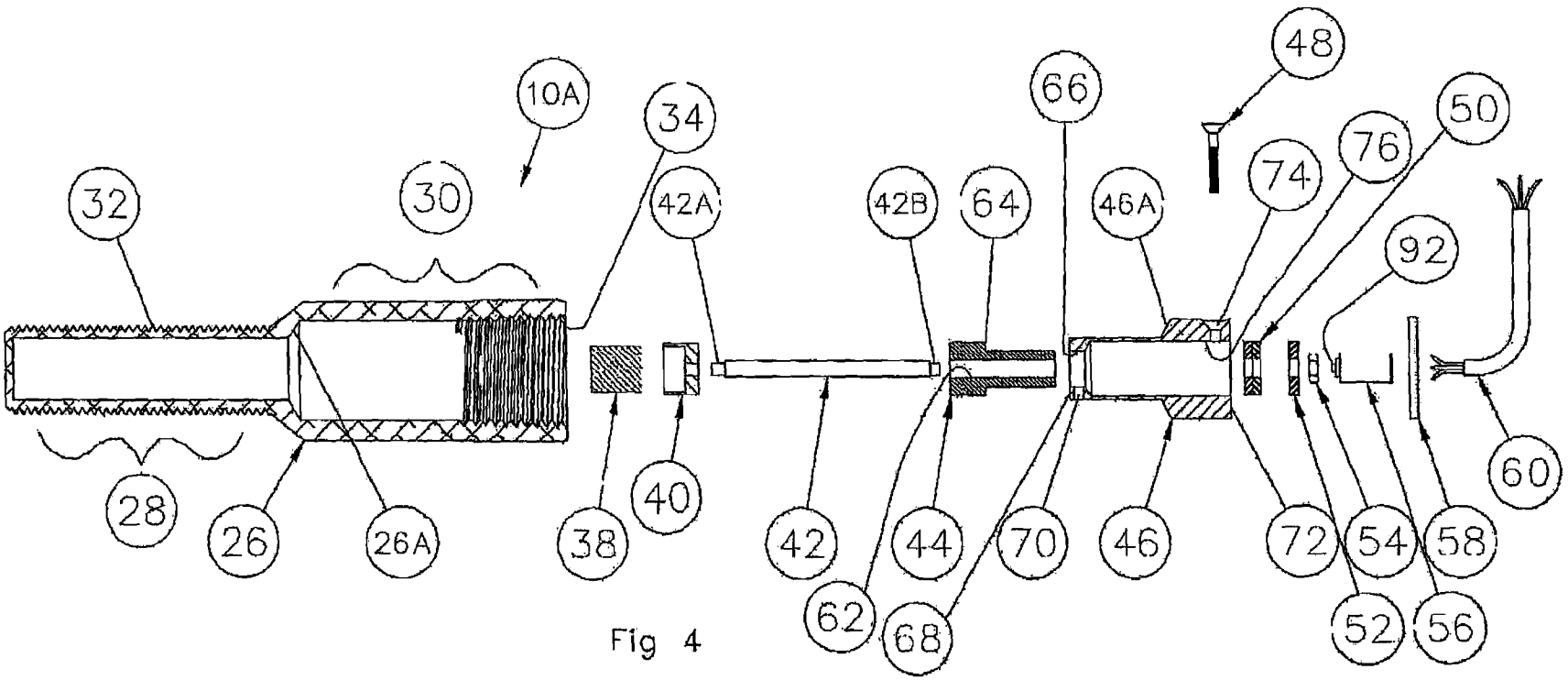
FIG. 4 is an exploded view, partially in cross-section, of the proximity sensor of FIG. 3.

FIGS. 3-6 depict the magnetic proximity switch 10A, which is identical to the switch 10B. Referring briefly to FIGS. 3 and 4, the proximity sensor 10A includes a hollow stainless steel sensor housing 26 with an externally threaded, closed left end portion 28, and an internally threaded, open right end portion 30. The external threads 32 are used to mount the proximity sensor 10A to a bracket 20 as shown in FIG. 1. The internal threads 34 are used to connect the proximity sensor 10A to an electrical conduit 36 as also shown in FIG. 1.

The proximity sensor 10A further includes a target magnet 38, a target magnet holder 40, an elongated shaft 42, a deadband and sensitivity adjustment screw 44, an anodized aluminum switch housing 46 (hereinafter also referred to as an inner housing 46), a switch retaining screw 48, a bias magnet assembly 50 (having a position that is determined by the deadband and sensitivity adjustment screw 44, as explained in more detail later), an end magnet 52, a nut 54 to retain the end magnet 52 on the shaft 42, a single pole double throw (SPDT) snap-action subminiature switch 56, a soldering board 58, and an electrical wiring cable 60. The housing 26 and the shaft 42 define an axial direction, which is also the direction of elongation and the direction in which the shaft moves relative to the housing.

In this embodiment, the target magnet 38, the bias magnet assembly 50, and the end magnet 52 are all rare earth magnets, made of neodymium iron boron, which are strong, lightweight magnets. The target magnet holder 40 is a low-weight aluminum alloy construction, and this, combined with the small and lightweight target magnet 38, results in a low mass target magnet assembly which improves the consistency of the trip distance regardless of the mounting orientation of the proximity sensor 10A.

The shaft 42 is a metal rod threaded at both ends. The target magnet holder 40 is threaded onto one end of the shaft 42, and the nut 54 is threaded onto the other end of the shaft 42.

The deadband and sensitivity adjustment screw 44 is a nylon socket head cap screw with an axial through-hole 62 drilled through it. The shaft 42 is slidably supported in this through-hole 62. The length of the deadband and sensitivity adjustment screw 44 provides an extended bearing surface for slidably supporting the shaft 42. This design prevents binding of the shaft 42 regardless of the target position or of the approaching direction of the target to the sensing area (the target magnet 38).

The deadband and sensitivity adjustment screw 44 has external threads 64, which thread into mating internal threads 66 in the switch housing 46. As is explained in more detail below, the deadband of the proximity sensor 10A may be adjusted by a threading the deadband and sensitivity adjustment screw 44 into or out of the switch housing 46.

Note: deadband is the change of input required to effect movement when direction of movement is reversed (total change in input which produces no output). A feature of deadband adjustment is that it permits consistency in the trip point from one switch to the next, regardless of tolerances of internal components, magnet strength, etc.

As indicated earlier, in this embodiment, the switch housing (or inner housing) 46 is an anodized aluminum hollow housing with internal threads 66 adjacent a first end 68 of the housing 46. Also adjacent this first end 68 is a radially directed through-opening 70. Once the deadband and sensitivity adjustment screw 44 has been threaded to the desired position in the factory (to calibrate the deadband to a desired specification), a drop of epoxy (or some other adhesive) is inserted through this opening 70 to lock the position of the deadband and sensitivity adjustment screw 44 relative to the inner housing 46. A retaining screw 48 enters through a second radially-directed through-opening 74 adjacent the second end 72 of the housing 46, and is used to fix the position of the switch 56 inside the housing 46.

To assemble the proximity sensor 10A, the target magnet 38 is pressed into the target magnet holder 40, which in turn is threaded onto the first end 42A of the shaft 42. The second end 42B of the shaft 42 is slid through the opening 62 of the deadband and sensitivity adjustment screw 44 until it projects beyond the end 72 of the inner housing. The bias magnet assembly 50 is slid over the second end 42B of the shaft 42 and into the cavity 76 of the inner housing 46. The end magnet 52 also is slid over the second end 42B of the shaft 42, and the nut 54 is then threaded onto the second end of the shaft 42. The bias magnet 50 and the end magnet 52 are assembled with their polarities opposed to each other, so they repel each other.

The terminals of the switch 56 are soldered to the soldering board 58, and the wires of the wire cable 60 also are soldered to the soldering board 58 to form a switch assembly. The switch assembly is pushed into the cavity 76 of the inner housing 46, and the switch 56 is fixedly secured to the inner housing 46 using the set screw 48 to form an inner housing assembly.

The inner housing assembly is mounted on a jig in the factory, and the deadband and sensitivity adjustment screw 44 is threaded into or out of the inner housing 46 until the desired position is reached. Once the desired dead band setting is achieved, a drop of epoxy is inserted into the opening 70 to fixedly secure the deadband and sensitivity adjustment screw 44 to the inner housing 46. This calibrated inner housing assembly is then inserted into the sensor housing 26, until the tapered enlargement 46A of the inner housing 46 abuts the corresponding tapered enlargement 26A of the sensor housing 26, and then the portion 78 (see FIG. 3) of the sensor housing 26 is filled with epoxy to seal the device and fix the inner housing 26 in position relative to the sensor housing 26.

Figure 7:
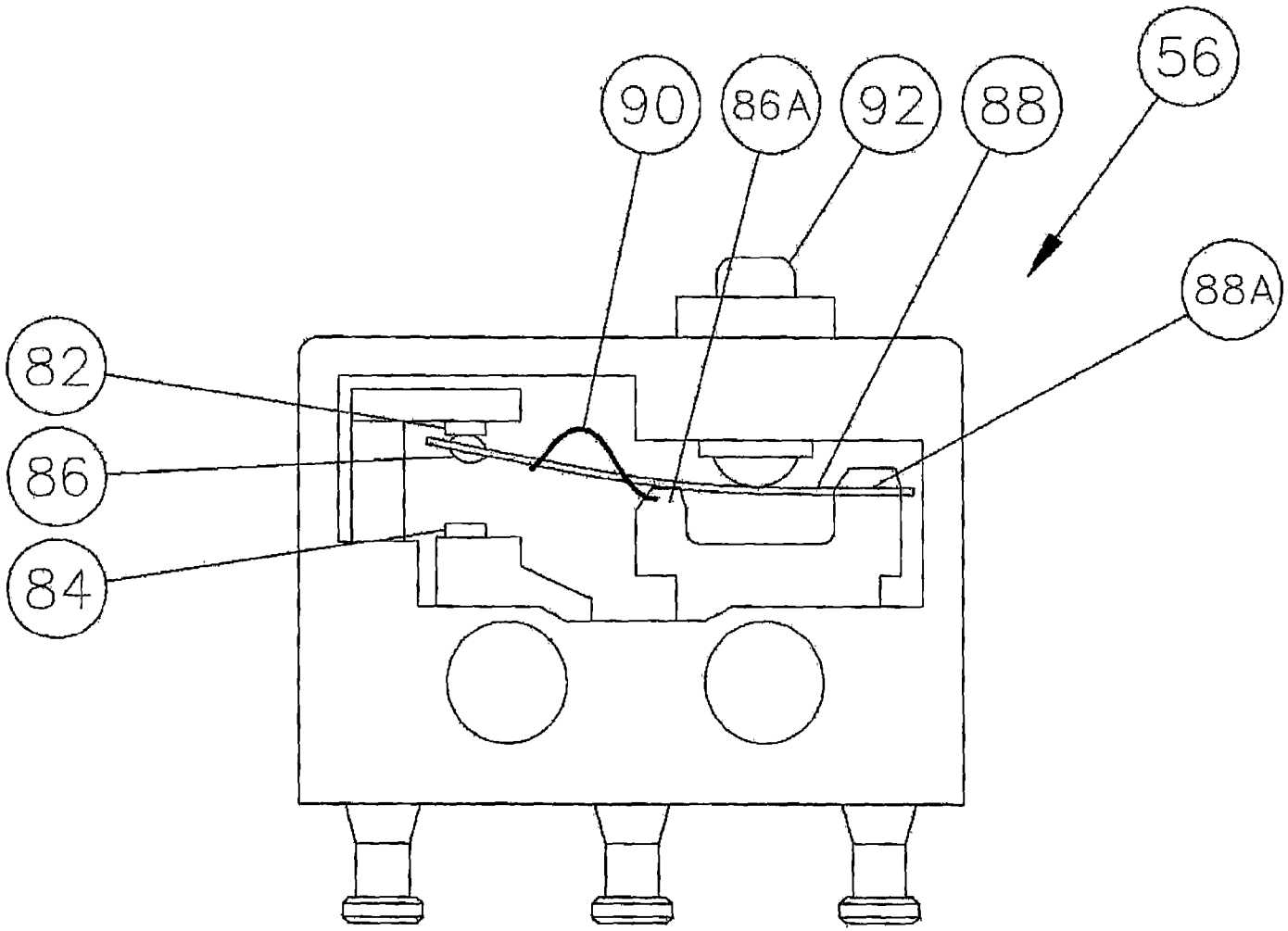
FIG. 7 is a cross sectional schematic of the electrical switch used in the proximity sensor of FIG. 1.

FIG. 7 illustrates the snap-action electrical switch 56, which is shown schematically in FIG. 4. The switch 56 includes a first contact 82, a second contact 84, and a common contact 86. A flexible element 88, which is part of the common contact 86, moves between a first position (as shown in FIG. 7) wherein the common contact 86 contacts the first contact 82, and a second position (not shown), wherein it contacts the second contact 84. A spring 90 biases the flexible element 88 toward the second contact 84. Depressing the button 92 causes the flexible element 88 to move downwardly to the right of the pivot point 86A, which exerts an upward force on the portion of the flexible element 88 to the left of the pivot point 86A. However, the spring 90 prevents the portion of the flexible element 88 to the left of the pivot point 86A from moving upwardly until the button 92 is depressed far enough to overcome the spring force, at which time the flexible element 88 suddenly and forcefully snaps to the first position, wherein the common contact 86 is in contact with the first contact 82. When the button 92 is released, the spring 90 immediately and forcefully snaps the flexible element 88 back to its second position.

Operation of the Proximity Sensor

Figure 5:
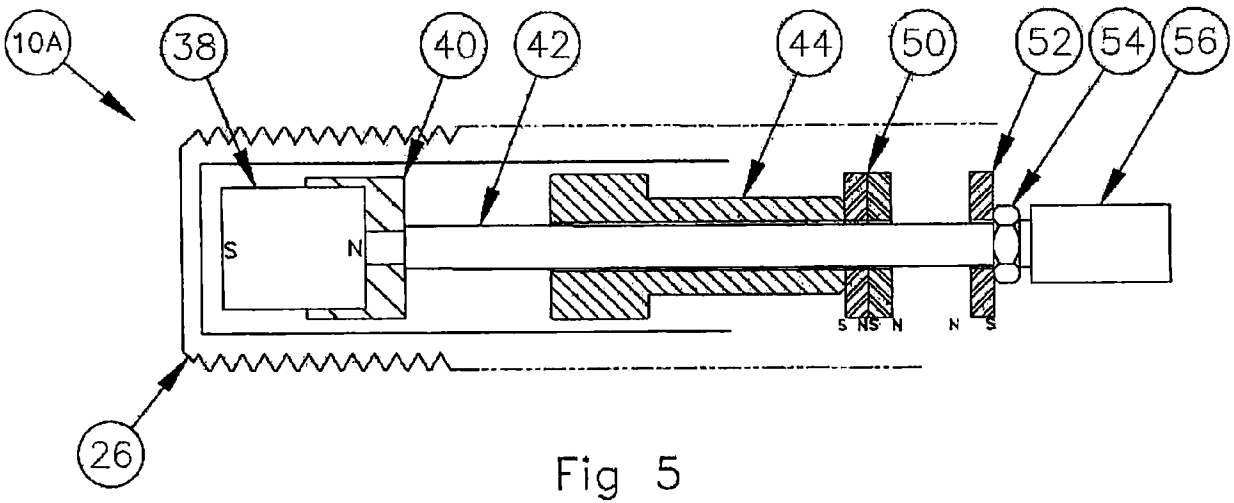
FIG. 5 is a broken away, cross sectional schematic of the proximity sensor of FIG. 3 when there is no target present.

FIG. 5 schematically depicts the position of the proximity sensor mechanism when there is no target present. The repelling force between the bias magnet assembly 50 and the end magnet 52 pushes the bias magnet assembly 50 to the left against the dead band adjustment screw 44 and pushes the end magnet 52 to the right against the nut 54. The dead band adjustment screw 44 is fixed to the inner housing 46 by the drop of epoxy in the opening 70, and the inner housing 46 is fixed relative to the sensor housing 26. The biasing magnet 50 cannot move to the left relative to the housing 26, because the dead band adjustment screw 44 is fixed relative to the housing 26, so the repelling force between the biasing magnet and the end magnet 52 causes the entire shaft assembly, including the shaft 42, the target magnet 38 and the end magnet 52, to shift rightwardly, depressing the button 92 (see FIG. 6), and bringing the common contact 86 and the first contact 82 into contact with each other.

Note that in this preferred embodiment 10A, the force biasing the shaft 42 rightwardly is the magnetic repelling force between the bias magnet 50 and the end magnet 52. Other biasing means known in the art, such as a spring, may be used instead of or in addition to the magnetic force to accomplish a similar biasing force.

Figure 6:
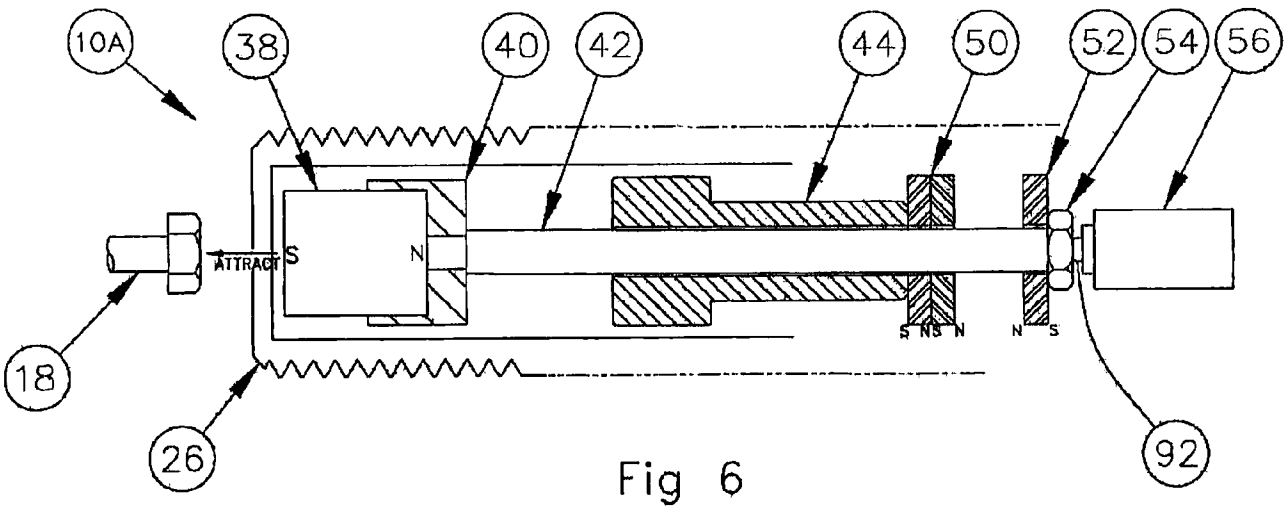
FIG. 6 is a view similar to that of FIG. 5 but when there is a target present.

FIG. 6 schematically depicts the position of the proximity sensor mechanism when the ferrous target 18 moves into position. The target magnet 38 is attracted to the ferrous target 18, overcoming the biasing force of the biasing magnet 50 and causing the entire shaft assembly to shift leftwardly. This releases the depressing force on the button 92 and thus allows the snap-action switch 56 to flip to the second position wherein the common contact 86 is in contact with the second contact 84.

With this arrangement, the strength of the magnetic attraction between the target magnet 38 and the target 18 does not determine the pressure acting on the contacts of the switch 56. Once the shaft assembly has shifted far enough to the left to release the button 92 on the switch 56, the snap-action of the switch 56 comes into play, flipping the contacts from the first position to the second position, and the pressure on the contacts is determined by the biasing forces within the switch 56, which are independent of the biasing forces on the shaft 42. This eliminates the problem of "teasing" or chattering of the contacts prevalent in prior art designs.

The switch 56 is stationary (fixed relative to the sensor housing 26). The button 92 on the switch 56 is actuated by the shaft 42. The shaft 42 either moves the button 92 far enough to trip the switch 56, or it does not move it far enough to trip the switch 56. If the shaft 42 moves the button 92 far enough, the button 92 activates or releases the snap-action mechanism of the switch 56, moving the set of contacts in the switch 56. In any event, the contacts always see a consistent contact pressure—the contact pressure of the biasing mechanism of the switch 56, not a contact pressure which depends on the degree of attraction between the target magnet 38 and the target 18.

It will be obvious to those skilled in the art that modifications may be made to the embodiments described above without departing from the scope of the present invention.

What is claimed is:

1. A proximity sensor, comprising:

a sensor housing defining a direction of elongation;

an elongated shaft supported for movement in the direction of elongation within said sensor housing, said shaft having first and second ends;

a target magnet secured to said first end of said shaft;

shaft biasing means for biasing said shaft in a first direction;

a switch mounted in said sensor housing, including first and second contacts and a common contact movable between said first and second contacts; and contact biasing means for biasing the common contact against at least one of said first and second contacts independent of said shaft biasing means.

2. A proximity sensor as recited in claim 1, and further comprising:

a bias magnet slidably supported on said shaft; and an end magnet retained on said shaft, wherein said shaft biasing means is a magnetic repelling force between said end magnet and said bias magnet.

3. A proximity sensor as recited in claim 2, and further comprising:

an inner housing fixed within said sensor housing and defining interior threads; and a dead band adjustment screw defining a through opening which slidably supports said shaft, said dead band adjustment screw having exterior threads which mate with the interior threads of said inner housing, wherein rotation of said dead band adjustment screw moves said dead band adjustment screw in the elongated direction relative to said inner housing.

4. A proximity sensor as recited in claim 3, wherein the repelling force between said bias magnet and said end magnet pushes said bias magnet against said dead band adjustment screw, and wherein said end magnet is mounted onto said shaft between said bias magnet and said second end of said shaft.

5. A proximity sensor as recited in claim 1, wherein said switch is a snap-action electrical switch, and the contact biasing means is the biasing force of the snap-action mechanism of said electrical switch.

6. A proximity sensor as recited in claim 5, wherein said switch includes a button movable between a depressed position, wherein said common contact is in contact with said first contact, and a second position, wherein said common contact is in contact with said second contact, and wherein said shaft drives said button to said depressed position.

7. A proximity sensor, comprising:

a sensor housing defining a direction of elongation;

an elongated shaft supported for movement in the direction of elongation within said sensor housing, said shaft having first and second ends;

a target magnet secured to said first end of said shaft;

shaft biasing means for biasing said shaft in a first direction;

a switch mounted in said sensor housing, including first and second contacts and a common contact movable between said first and second contacts;

an inner housing fixed within said sensor housing and defining interior threads; and a dead band adjustment screw defining a through opening which slidably supports said shaft, said dead band adjustment screw having exterior threads which mate with the interior threads of said inner housing, wherein rotation of said dead band adjustment screw moves said dead band adjustment screw in the elongated direction relative to said inner housing.

8. A proximity sensor as recited in claim 7, and further comprising contact biasing means for biasing the common contact against at least one of said first and second contacts independent of said shaft biasing means.

9. A proximity sensor as recited in claim 8, and further comprising:

a bias magnet slidably supported on said shaft; and an end magnet retained on said shaft, wherein said shaft biasing means is a magnetic repelling force between said end magnet and said bias magnet.

10. A proximity sensor as recited in claim 9, wherein the position of said bias magnet is determined by the position of said dead band adjustment screw relative to said inner housing, and wherein said end magnet is mounted onto said shaft between said bias magnet and said second end of said shaft.

11. A proximity sensor as recited in claim 10, wherein said switch is a snap-action electrical switch, and the contact biasing means is the snap-action mechanism of said electrical switch.

12. A proximity sensor as recited in claim 11, wherein said switch includes a button movable between a depressed position wherein said common contact is in contact with said first contact, and a released position wherein said common contact is in contact with said second contact, and wherein said shaft drives said button to said depressed position.

* * * * *